United States Patent [19]

Willcox

[11] 4,047,608

[45] Sept. 13, 1977

[54] COMPLIANT RIBBON-GUIDING STRUCTURE

[76] Inventor: Frederick P. Willcox, 565 Oenoke Ridge, New Canaan, Conn. 06840

[21] Appl. No.: 672,710

[22] Filed: Apr. 1, 1976

[51] Int. Cl.[2] ..... B41J 33/06

[52] U.S. Cl. ..... 197/151; 101/336; 197/170

[58] Field of Search ..... 197/151, 168, 170; 101/336; 226/196, 198; 360/130

[56] References Cited

U.S. PATENT DOCUMENTS

| | | | |
|---|---|---|---|
| 3,726,381 | 4/1973 | Murphy | 197/168 |
| 3,977,512 | 8/1976 | Teagarden et al. | 197/151 X |

FOREIGN PATENT DOCUMENTS

| | | | |
|---|---|---|---|
| 2,019,648 | 11/1971 | Germany | 197/170 |

*Primary Examiner*—Edgar S. Burr

*Assistant Examiner*—Paul T. Sewell

*Attorney, Agent, or Firm*—William D. Hall; Geoffrey R. Myers

[57] ABSTRACT

A compliant structure formed of resilient tape of the self-straightening type is used to guide a web of thin material which is transferred between two machine elements that have relative motion to each other. The structure is applied to a ribbon supply and take-up system for typewriters and teleprinters of the type having a carriage-transported printing device. The resilient tape, with one surface being used to guide the ribbon, is connected and constrained between a frame-supported ribbon supply and take-up assembly and the printing device carriage to form a loop-like structure for guiding and generally supporting the ribbon along a path of constant length regardless of carriage position. The compliant ribbon-guiding structure is also incorporated into an easily installable ribbon carriage.

33 Claims, 7 Drawing Figures

COMPLIANT RIBBON-GUIDING STRUCTURE

CROSS-REFERENCE TO RELATED APPLICATION

A. Co-pending patent application No. 672,699 filed on even date herewith and entitled "Articulated Ribbon-Guiding Structure", provides a different structure for the same purpose as this invention and discloses material incorporated herein.

BACKGROUND OF THE INVENTION

1. Field of the Invention

This invention pertains to apparatus for delivering printing ribbon from a stationary source to a moving carrier; said carrier carrying the printing means and moving with respect to the paper (or other medium that receives the printing) as printing proceeds, the paper being supported by a stationary paper holder such as a conventional carriage.

2. Description of the Prior Art

With the advent of practical and widely used by and teleprinters which have a printing device which is carriage-transported back and forth along a writing line, it became necessary to provide ribbon supply and take-up systems which also could be transported by the carriage in order to conserve ribbon which otherwise would be wasted during non-printing movements of the carriage and to obviate the need for contrivances and devices to conserve or lengthwise adjust the ribbon such as the loop formers shown in my U.S. Pat. No. 3,534,847 or other mechanisms as shown in U.S. Pat. Nos. 2,609,077; 3,236,353; or 3,726,381. In order to simplify ribbon threading, many of the present systems have taken the form of an easily installed ribbon supply and take-up cartridge or cassette which is supported by the carriage. Unfortunately, these carriage-supported systems have severe drawbacks. They add considerable weight to the carriage, require ribbon feeding devices and ribbon take-up drives which add considerable weight and complexity to the carriage, and are limited in ribbon supply capacity due to weight and available space considerations. These drawbacks are eliminated by this invention.

Prior U.S. Pat. Nos. to Rumbutis 2,240,578, issued May 6, 1941, "Typewriter Machine"; Toggenburger 2,425,967, issued Aug. 19, 1947, "Ribbon Feed for Typewriter Machines"; Brumhill 2,467,881, issued Apr. 19, 1949, "Ribbon Guiding Means for Typewriters"; Brumhill 2,479,669, issued Aug. 23, 1949, "Ribbon Feeding Mechanism for Typewriters"; Brumhill 2,513,137, issued June 27, 1950, "Ribbon Feeding and Guiding Means For Typewriter and Like Machines"; Schroder 2,609,077, issued Sept. 2, 1952, "Ribbon Feed for Typewriter Machines"; Korner 2,889,908, issued June 9, 1959, "Typewriter Attachment"; Perucca 3,675,753, issued July 11, 1972, "High-Speed Printer"; and Garberi et al 3,889,795, issued June 17, 1975, "Removable Cartridge for the Inked Ribbon for Typewriters, Calculating Machines or Other Office Machines", disclose a stationary ribbon supply and take-up means coacting and/or cooperating with a movable carriage.

Furthermore, resilient metal tape of concavo-convex shape is known, see U.S. No. 1,964,280 to Witchger, issued June 26, 1934, "Tape Measure", and U.S. Pat. No. 1,973,843 to Buck, issued Sept. 18, 1934, "Measuring Tape".

In addition, ribbon cartridges for use on the movable printing carriage of a typewriter are known in which the cartridge may be inserted in the machine without the necessity of threading inky ribbon through fixed guides on the machinery, see U.S. Pat. No. 3,941,231 to Matuck et al, issued Mar. 2, 1976, "Ribbon Cartridge".

SUMMARY OF THE INVENTION

This invention provides a simple and effective compliant structure for guiding a web of thin material which is transferred between two machine elements that have limited relative motion between them. The compliant structure employs resilient tape, preferrably of the self-straightening type, which is connected between the machine elements and constrained to form a straight-sided loop-like structure of a U-shaped formation, with the web being guided and generally supported on the outer surface of the tape forming the loop.

The invention is also incorporated into typewriters and teleprinters of the type which have a printing device supported on a carriage for positioning back and forth along a writing line. The compliant structure, of resilient tape as above, is used to guide and support a printing ribbon between the carriage-supported printing mechanism and a frame-supporting ribbon supply and take-up assembly along a path of constant length regardless of the position of the carriage along the writing line.

The compliant ribbon-guiding structure, using resilient tape as before, is incorpoated into a ribbon supply and take-up cartridge assembly which can be supplied pre-threaded for ease of installation, and is inexpensive to manufacture. The resilient tape for these applications is not only of the self-straightening type with a non-planar cross-sectional shape when straight, but preferrably has a normally concavo-convex cross-sectional shape with the concave surface being used to guide the ribbon.

Inasmuch as the compliant guiding structure is very light in weight, the inertial load presented to the carriage positioning motor is very low, thus enabling faster operation of the machine. Because a frame-supported ribbon supply and take-up assembly is used, a much larger ribbon supply is practical.

DESCRIPTION OF THE PREFERRED EMBODIMENTS

Figure 1:
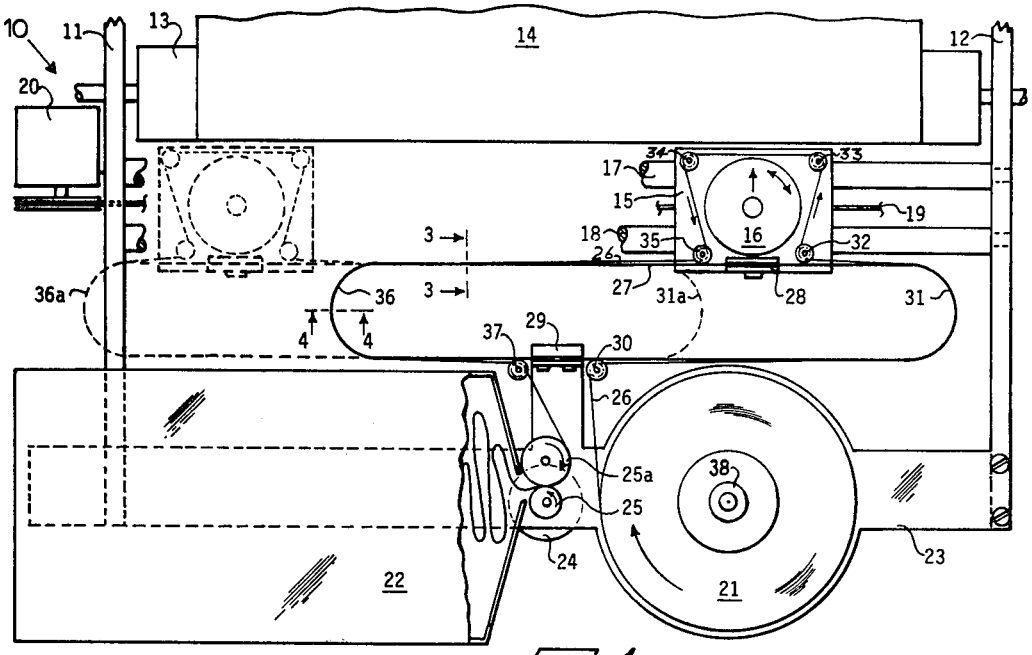
FIG. 1 is a top view showing the general plan of a printer incorporating a compliant ribbon-guiding structure connected between the print carriage and the ribbon supply and take-up assembly.

Referring to FIG. 1 of the drawings, a printer is generally indicated by the reference number 10. The left and right side members of the machine frame are indicated at 11 and 12 respectively. The platen 13, journalled in side members 11 and 12, supports a record medium 14. A printing apparatus carriage 15 includes and supports a schematically shown printing mechanism or device 16 and ribbon positioning means (to be described later). Device 16 is positioned or otherwise actuated for character selection and printing by means not shown. Carriage 15 is guided along the writing line by rods 17 and 18 and is moved back and forth by stepping motor 20 acting through cable 19. A ribbon supply roll 21 and a used ribbon take-up receiver box 22 are removably supported by frame cross-member 23. The incremental ribbon advancing and take-up motor 24, also supported by cross-member 23, drives a take-up roller 25 and mating pitch roller 25a to draw ribbon web 26 past the printing device 16 and feed used ribbon into the take-up storage box 22.

The generalized printer structure just described may be of any of the well-known single element or matrix types, or may be of the type shown in detail in my U.S. Pat. No. 3,534,847, or include the printing mechanism structure shown in my U.S. Pats. Nos. 3,731,778 and 3,892,303 for example.

The ribbon web 26 drawn from supply 21 is guided and generally supported to carriage 15 and back to take-up storage box 22 by a bi-laterally disposed compliant guide structure formed by band 27. Band 27 is made of resilient tape of the self-straightening type with a normally non-planar cross-sectional shape, preferably a concavo-convex shape. The middle portion of band structure 27 is fastened to carriage 15 by clamp 28. The two ends of band 27 are brought together, end-to-end, and are held in a fixed anchor position adjacent the ribbon supply and storage structure generally midway the width of the machine by clamp 29 which is affixed to cross-member 23 in the example as shown. Tape or band 27 is thus constrained to form a relatively narrow flattened loop with two rolling bends. Clamps 28 and 29 are constructed to preserve the cross-sectional shape of the tape, and the band 27 is preferrably clamped with the concave surface of the tape outward of the loop-like structure with the ribbon guided along that surface.

Figure 2:
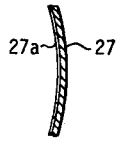
FIG. 2 is an enlarged cross-section of the preferred resilient tape used to form the compliant guiding structure. The tape thickness is exaggerated.

Referring to FIG. 2, the resilient tape, band 27, shown with exaggerated thickness and of the preferred concavo-convex shape, is made of spring tempered steel or like material and is further preferrably coated with a material 27a which has a very low co-efficient of friction and is compatable with the ribbon material. One practical coating would be a backed on, very thin coating of polytetrafluoroethylene. In the construction shown, band 27 is assumed to have a thickness of 0.005 in. (0.12 mm.), a width of 0.5 in. (12.5 mm.), and cross-sectional radius of about 0.75 in. (19 mm.). When a resilient tape of such dimensions is constrained as shown in FIG. 1 with the concave surface outward of the loop, the arcuate bends thus formed have a natural radius of about 0.7 in. (18 mm.). This natural radius determines the distance clamping member 29 is placed from the back and forth path of the carriage clamp 28. Because of the non-planar cross-sectional shape of band 27, it is inflexible enough to remain straight except at the bends, and with dimensions such as above and shown in FIG. 1, (where the assumed diameter of the ribbon supply roll is 4 in. (10 cm.) and the other dimensions are in like proportion), the loop-like structure is self-supporting when clamped as shown.

Referring back to FIG. 1, the path of ribbon web 26 is as follows: from supply reel 21 to, and around an aligning idler or flanged roller 30 which is supported by cross-member 23, and thence onto band 27 and around loop or bend 31, and then along the band to a spool-like roller 32. Then around roller 32 and along a path around other spool-like rollers 33, 34, and 35 and back onto band 27, around bend 36, and thence to another flanged roller 37 which is supported by member 23. The ribbon web then goes to and around pinch roller 25a and between it and take-up drive roller or capstan 25 and thence into take-up storage box 22. Rollers or guides 32, 33, 34, and 35 are pivoted on small diameter pins supported by carriage 15. Rollers 33 and 34 may be part of a ribbon vibrator or other mechanism which positions the ribbon for printing or, for space considerations, may be metal guides.

Figure 3:
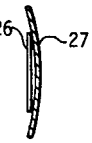
FIG. 3 is an enlarged cross-section of the resilient tape and supported ribbon taken along lines 3—3 in FIG. 1.
Figure 4:
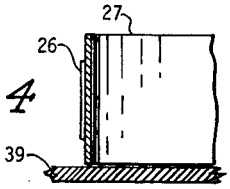
FIG. 4 is another enlarged cross-section of the resilient tape and ribbon taken along lins 4—4 in FIG. 1.

FIG. 3 shows the ribbon web 26 in relation to the concave surface of resilient tape 27 at one point in its path. FIG. 4 shows the ribbon web 26 and the tape 27 at a point in one arcuate bend and shows how the tape flattens out in the bend portion of the compliant structure. Also shown is a broken away portion of an auxiliary support plate 39 which is placed just below or adjacent the back and forth path of band 27 and extending from side to side of the printer and supported by members 11 and 12. This plate 39 serves to support the ribbon web should it become slack, as in threading, or temporarily lose the tension which normally holds it in contact with the band 27.

Referring back to FIG. 1, the ribbon web 26 is normally held against the surface of band 27 by the tension placed on the web by the take-up drive pulling against the drag of the web around bends 31 and 36 and the further drag of the supply roll 21. However, in cases where the supply roll 21 might tend to over-run, any of the well-known tensioning means can be used to prevent such over-run each time the ribbon is incrementally taken up or "fed" into the take-up storage box 22. Such means might be as simple as using a friction type of drag hub 38 which forms the cross-member supported pivot for ribbon supply roll 21. Further, while a ribbon take-up box 22 is shown, a ribbon take-up spool or reel could easily be used in conjunction with a combined incremental feed and take-up drive as disclosed in 153

While a preferred combined ribbon feeding or advancing and take-up mechanism is shown in FIG. 1 in conjunction with a separate used ribbon storage box, a separate ribbon advancing device can be used and may even be supported by carriage 15, and some common form of slipping drive applied to the take-up structure and mechanism, all as well-known in the art.

Still referring to FIG. 1, the essentially constant radius bends 31 and 36 in band structure 27 become rolling loops when the carriage 15 is moved in either direction. The respective instant centers of curvature of the bends move parallel to the carriage line of travel at one-half the carriage movement rate. If the carriage 15 is moved to the dotted line position, which is near a left margin position, bend 31 moves or "rolls" to the dotted line position **31*a*, and bend 36 to dotted line position 36*a*,** thus maintaining a fixed length guiding path for the ribbon web.

The forces required to change the bends in band structure 27, that is, to "bend" previously straight portions of the loop-like structure, whenever carriage 15 is moved, are balanced by the un-coiling forces which tend to straighten out the bends. The hysteresis losses thus incurred when the loops "roll" are negligible. While the bi-lateral band disposition into the flattened loop is the preferred structure, two bands, constrained to form two generally U-shaped structures, one inside the other, or one above or alongside each other, could be used but with the penalty of adding ribbon path complexity. Further, instead of constraining the band into a flattened loop as shown, the fixed anchor at clamp 29 could be at a greater distance from the path of the carriage 15 so as to form or constrain the resilient tape into a triangular structure having three "natural" radius bends, with the apex bend being clamped with its radius being maintained to carriage 15 for example. The two remaining bends would then be free to "roll" back and forth whenever the carriage is moved.

Figure 5:
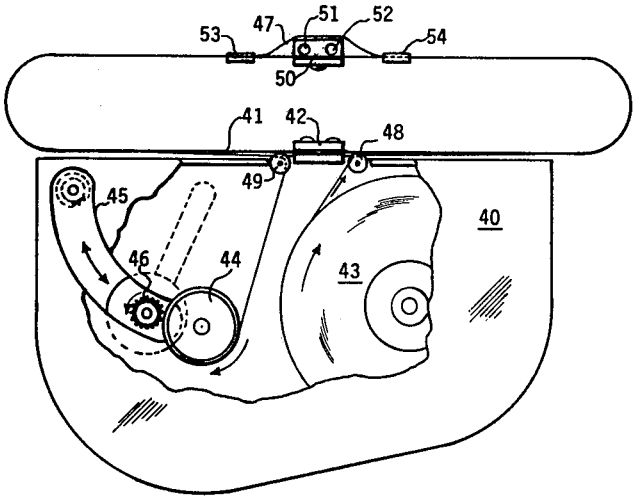
FIG. 5 is a top plan view of the compliant structure incorporated into a ribbon supply and take-up cartridge assembly.

FIG. 5 shows the appliction of the compliant ribbon-guiding structure to a removable and disposable ribbon supply and take-up cartridge 40. A resilient tape 41 is adjoined or attached to cartridge 40 by clamp 42 and is thus constrained to form a narrow, flattened loop-like structure similar to that shown in FIG. 1 and previously described in detail. The cover of cartridge 40 is partially broken away to show the ribbon supply roll 43 and take-up drum or core 44. The cartridge 40 has an arcuate slot or aperture 45 in its cover and a like slot in the cartridge bottom member. A frame-supported ribbon take-up drive 46, similar to that described and shown in co-pending cross-reference A, projects in to the apertured area and swings outward, that is, clockwise in FIG. 5, as the take-up roll grows in size. Cartridge 40 is supported in a printer by a frame member such as cross-member 23 in FIG. 1. The ribbon web 47 is guided from supply roll 43 to tape 41 by a roller 48, which is supported by the cartridge, around band or tape 41 to another cartridge-supported roller 49 and thence to take-up drum 44. As previously pointed out other types of take-up drive and ribbon advancing can be used.

Resilient tape 41 has a small clamp-like attachment fitting 50 affixed thereto midway of the flattened loop. Fitting 50 has two holes 51 and 52 for removable attaching the tape 41 to the printer carriage. When the cartridge 40 is pre-threaded with ribbon, ribbon web 47 is looped around the compliant structure and passes on the outside of fitting 50 and is retained on either side thereof by temporary packaging clips 53 and 54. So much of the ribbon web as lies between clips 53 and 54 may be a loose loop of sufficient length to go around the carriage-supported guide rollers as in FIG. 1. After cartridge installation and loop threading, clips 53 and 54 would be removed and discarded and any slack in the ribbon web taken up by manually rotating drive 46. If clamp fitting 50 is omitted, tape 41 can be held in position on the printer carriage by a spring-loaded hinge type clamp.

Figure 6:
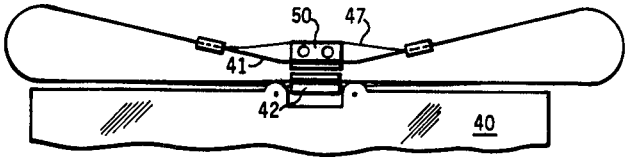
FIG. 6 is a further top plan view of part of the ribbon cartridge of FIG. 5 showing how the ribbon-guiding structure is "collapsed" for convenience in packaging.

Although the compliant ribbon-guiding structure is generally self-supporting as in FIG. 5, it is desirable, for packaging purposes and ease of installation to provide additional support. FIG. 6 shows tape 41 pulled into a "bow tie" configuration by bringing fitting 50 up to the cartridge clamp 42 where it would be held in position by any suitable temporary clip. This clip would be removed when the cartridge is installed in a printer.

Figure 7:
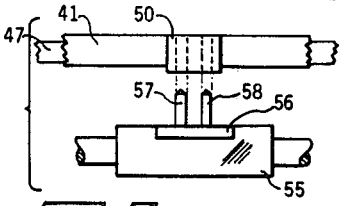
FIG. 7 is a partial front elevation showing one form of how the compliant ribbon-guiding structure is removably supported by the print carriage.

In the exploded view of FIG. 7, a print carriage 55, similar to carriage 15 of FIG. 1, has a projecting bracket 56 supporting two upward extending pins 57 and 58 which engage holes 51 and 52 in fitting 50. Thus it can be seen that when the cartridge is installed, fitting 50 is lifted up out of its normal plane and placed over pins 57 and 58 for support and proper alignment of tape 41. A loop of ribbon is then drawn from the cartridge and placed around the carriage-supported ribbon guides as shown in FIG. 1.

Again referring to FIG. 5, cartridge 40 is shown containing a ribbon take-up spool. This is not necessary if a separate storage container for used ribbon is employed as in FIG. 1. Whether or not the cartridge incorporates means for storing the used ribbon, its cost of fabrication, including the compliant ribbon-guiding structure, is very low, and the design is ideal for automated assembly and pre-threading.

When the space required for the flattened loop-like structure of FIG. 1 is compared with the space requirements of the articulated ribbon-guiding structure of cross-reference A, it will be seen that the space utilization is more effective, and this makes it practical to employ a very large ribbon supply roll of 6 to 8 inches (15 to 20 cm.) diameter. The entire supply and take-up assembly and compliant ribbon-guiding structure can be tilted downward to fit under a typewriter keyboard, which would be hinged for access to the assembly.

The compliant ribbon-guiding structure has been shown and described in relation to the use of a ribbon which is used for printing. This ribbon may be of any type such as the re-usable inked variety, a high yield polymer matrix type, or any single pass type such as a total release type of carbon ribbon. The same general compliant ribbon-guiding structure can also be used to guide and support a correcting ribbon of either the adhesive lift-off type or the printing obliterating cover-up type.

While the invention has been particularly shown and described with reference to the preferred embodiments thereof, it will be understood by those skilled in the art that various changes in form and detail and in applying the concepts of the invention may be made without departing from the spirit or scope thereof.

I claim to have invented:

1. In a printing machine of the kind having a frame, and a printing carriage movable with respect to said frame along a printing path, said printing carriage comprising printing means, the improvement comprising:

ribbon supply means carried by said frame and relatively stationary as compared to said movable printing carriage for storing a supply of pliant ribbon, said ribbon supply means having an output, ribbon directing means on the movable printing carriage for directing said ribbon past the printing means, said ribbon directing means having an input on said movable printing carriage, and flexible ribbon-guide-means for guiding the pliant ribbon from the ribbon supply means to the ribbon directing means, said flexible ribbon-guide-means including means uniformly flexible throughout its entire length for guiding the ribbon from said output to said input along a path of unvarying length irrespective of the position of said movable printing carriage along its printing path.

2. In a printing machine as defined in claim 1, said flexible ribbon-guide-means comprising a flexible band having one end supported adjacent said output of said ribbon supply means and the other end attached to said movable printing carriage, said flexible band constrained between said supported one end and said movable printing carriage to form a partially looped compliant structure which is free to flex in a plane which is parallel to said printing path, and means for guiding said pliant ribbon from said output along the flexible band and around the partially looped compliant structure to said input of said ribbon directing means to thus provide said path of unvarying length.

3. In a printing machine as defined in claim 2, said flexible band comprising resilient tape of the self-straightening type with a normally non-planar cross-sectional shape constrained to form said partially looped compliant structure, and said resilient tape has a ribbon guiding surface which is disposed outwardly of the partially looped compliant structure for guiding one face of the ribbon therealong.

4. In a printing machine as defined in claim 3 in which said normally non-planar cross-sectional shape of said resilient tape is a normally concavo-convex shape and said tape is constrained with the normally concave surface outward of said partially looped compliant structure to provide said ribbon guiding surface.

5. In a printing machine as defined in claim 3 in which said partially looped compliant structure formed of said resilient tape is a generally U-shaped structure having a first straight portion of said tape extending from said supported end and a second straight portion extending from said attached end, and said first and second portions of the tape are connected by a position-variable arcuate bend portion which is free to roll along the tape thus changing the relative lengths of the first and second straight portions to maintain said path of unvarying length whenever said printing carriage is moved along its printing path.

6. In a printing machine as defined in claim 1, a casing for containing said ribbon supply means, said casing comprising a ribbon cartridge which is adapted to be received by said frame, said flexible ribbon-guide-means has a portion which is adapted for attachment to said casing and is attached thereto, and said flexible ribbon-guide-means has another portion which is adapted for connection to said movable printing carriage.

7. In a printing machine of the kind having a frame, and a printing apparatus which employs a pliant ribbon, said printing apparatus movable with respect to said frame along a writing line to produce printing on a record medium supported thereat, the improvement comprising:

ribbon supply and take-up means carried by said frame and relatively stationary as compared to said printing apparatus, for storing a supply of said ribbon and for taking up the ribbon after use, said ribbon supply and take-up means having a ribbon output and a ribbon input, and flexible ribbon-guide-means connected between said ribbon supply and take-up means and said printing apparatus, said flexible ribbon-guide-means including means comprising a bond for guiding said ribbon from said ribbon output to the printing apparatus and then back to said ribbon input along a path of unvarying length irrespective of the position of the printing apparatus along said writing line.

8. In a printing machine as defined in claim 7, means for advancing the ribbon as printing proceeds comprising means for applying tension to the portion of the ribbon which has returned along said path, and said means for advancing the ribbon further comprising means for effecting take-up of said returned ribbon.

9. In a printing machine as defined in claim 7, said flexible ribbon-guide-means comprising a flexible band means having two partially looped compliant sections, said partially looped compliant sections being free to flex in a plane which is parallel to said writing line, and means for guiding said ribbon from said ribbon output along the band and around one of said partially looped compliant sections to said printing apparatus and then back along and around the other partially looped compliant section to said ribbon input thus providing said path of unvarying length.

10. In a printing machine as defined in claim 9, said partially looped compliant sections of said flexible band means comprise resilient tape of the self-straightening type with a normally non-planar cross-sectional shape, and said resilient tape has a ribbon guiding surface which is disposed outward of the respective partially looped compliant section for guiding one face of said ribbon therealong.

11. In a printing machine as defined in claim 10 in which said normally non-planar cross-sectional shape of said tape is a concavo-convex shape with the normally concave surface outwardly disposed of said partially looped compliant sections.

12. In a printing machine as defined in claim 10, said partially looped compliant sections of said resilient tape are generally U-shaped sections and each section has a position-variable arcuate bend therein, said arcuate bends being free to roll along said resilient tape in unison whenever said printing apparatus is moved along said writing line.

13. In a printing machine as defined in claim 7, a casing for containing said ribbon supply and take-up means, said casing comprising a ribbon cartridge adapted to be carried by said frame, and said flexible ribbon-guide-means has one portion attached to said cartridge, and another portion thereof adapted for removably attaching to said printing apparatus.

14. In a printing machine as defined in claim 7, said flexible ribbon-guiding-means comprising resilient tape means constrained to form a compliant and generally loop-shaped structure, and said means for guiding ribbon comprises the outside surface of said loop-shaped structure and said ribbon is guided and generally supported therealong to provide said path of unvarying length.

15. In a printing machine as defined in claim 14, said resilient tape means comprises tape of the self-straightening type with a normally concavo-convex cross-sectional shape and is constrained with the normally concave surface outward of said loop-shaped structure.

16. In a printing machine as defined in claim 15, said compliant loop-shaped structure is a narrow flattened loop having two bi-laterally disposed position-variable arcuate bends therein whose instant centers of curvature vary in position along a path parallel to said writing line and in unison with said printing apparatus whenever the printing appartus is moved along the writing line.

17. In a printing machine as defined in claim 14, means for advancing the ribbon as printing proceeds comprising means for applying tension to the portion of ribbon which has returned along the surface of said loop-shaped structure, and said means for advancing the ribbon further comprising means for effecting the taking up of said returned ribbon.

18. In a printing machine as defined in claim 14, a casing for containing said ribbon supply and take-up means, said casing comprising a ribbon cartridge adapted to be carried by said frame, and said compliant loop-shaped structure is attached to said casing and is adapted for connection to said printing apparatus.

19. A ribbon cartridge for use in a printing machine which machine has stationary means for receiving said cartridge, and has a printing apparatus which is movable with respect to said stationary means along a writing line to produce printing on a record medium supported thereat, comprising:

ribbon supply means for storing a supply of ribbon, said ribbon supply means having a ribbon output, a casing for said ribbon supply means and adapted to be supported by said stationary means, and flexible ribbon-guide-means attached to said casing and comprising a non-articulated closed loop for connecting to said printing apparatus to guide the ribbon from said output of said printing apparatus and then back to a position adjacent said output along a path of unvarying length irrespective of the position of the printing apparatus along said writing line.

20. A ribbon cartridge as defined in claim 19 in which said printing machine further has ribbon take-up means also supported by said stationary means for advancing and taking up the ribbon as printing proceeds comprising means for applying tension to the portion of ribbon which has returned from said printing apparatus along said path to said adjacent position.

21. A ribbon cartridge as defined in claim 19, said flexible ribbon-guide-means comprising resilient tape means constrained by said attachment to said casing to form a compliant closed loop structure, said resilient tape means having a ribbon guiding surface outwardly disposed of said loop structure for guiding the ribbon therealong, and said loop structure being connectable, at a point midway therearound from said attachment, to said printing apparatus to provide said path of unvarying length.

22. A ribbon cartridge as defined in claim 21, said resilient tape means comprising resilient tape of the self-straightening type with a normally concavo-convex cross-sectional shape with the normally concave surface being said ribbon guiding surface, and said compliant closed loop structure is a flattened loop having two bi-laterally disposed position-variable arcuate bends therein which are free to change position in unison to follow the motion of said printing apparatus along its writing line whenever said structure is connected to the printing apparatus.

23. A ribbon cartridge for use in a printing machine which machine has stationary means for receiving said cartridge, and has a printing apparatus which is movable with respect to said stationary means along a writing line to produce printing on a record medium supported thereat, comprising:

ribbon supply means for storing a supply of ribbon, said ribbon supply means having a ribbon output, ribbon take-up receiving means for storing used ribbon, said ribbon take-up receiving means having a ribbon input, a casing for said ribbon supply means and said ribbon take-up receiving means, said casing including means enabling it to be supported by said stationary means, and flexible ribbon-guide-means attached to said casing and including means for connecting it to said printing apparatus for guiding the ribbon from said output to the printing apparatus and then back to said input along a path of unvarying length irrespective of the position of the printing apparatus along said writing line said ribbon guide means being continuously flexible along substantially its entire length.

24. A ribbon cartridge as defined in claim 23 in which said printing machine further has means also supported by said stationary means for advancing the ribbon as printing proceeds comprising means for applying tension to the portion of ribbon which has returned from said printing apparatus along said path, and further comprising means for effecting take-up of said returned ribbon.

25. A ribbon cartridge as defined in claim 24, said flexible ribbon-guide-means comprising resilient tape means constrained by said attachment to said casing to form a compliant closed loop structure, said resilient tape means having a ribbon guiding surface outwardly disposed of said loop structure for guiding the ribbon therealong, and said loop structure being connectable, at a point midway therearound from said attachment, to said printing apparatus to provide said path of unvarying length.

26. A ribbon cartridge as defined in claim 25, said resilient tape means comprising resilient tape of the self-straightening type with a normally concavo-convex cross-sectional shape with the normally concave surface being said ribbon guiding surface, and said compliant closed loop structure is a flattened loop having two bi-laterally disposed position-variable arcuate bends therein which are free to change position in unison to follow the motion of said printing apparatus along said writing line whenever said loop structure is connected to the printing apparatus.

27. A ribbon cartridge as defined in claim 25, clips for holding the ribbon to the resilient tape means on either side of said midway point that is to be connected to said printing apparatus.

28. A ribbon cartridge as defined in claim 25, means cooperative with said ribbon supply means and said means for applying tension to maintain sufficient tension on said ribbon when the ribbon is not being advanced to keep said ribbon in contact with said ribbon guiding surface.

29. In a printing machine of the kind having a frame, and a printing carriage movable with respect to said frame along a printing path, said printing carriage comprising printing means, the improvement comprising:

ribbon supply means carried by said frame and relatively stationary as compared to said movable printing carriage for storing a supply of flexible ribbon, said ribbon supply means having an output, ribbon directing means on the movable printing carriage for directing flexible ribbon past the printing means, said ribbon directing means having an input on said movable printing carriage, and flexible-ribbon guide means for guiding the flexible ribbon from the ribbon supply means to the ribbon directing means, said flexible-ribbon guide means including a band for guiding flexible ribbon from said output to said input along a path of unvarying length irrespective of the position of said movable printing carriage along its printing path.

30. In a printing machine as defined in claim 29, a casing for containing said ribbon supply means, said casing comprising a ribbon cartridge which is adapted to be received by said frame, said flexible-ribbon guide means has a portion which is adapted for attachment to said casing and is attached thereto, and said flexible-ribbon guide means has another portion which is adapted for connection to said movable printing carriage.

31. In a printing machine of the kind having a frame, and a printing carriage movable with respect to said frame along a printing path, said printing carriage comprising printing means, the improvement comprising:

ribbon supply means carried by said frame and relatively stationary as compared to said movable printing carriage for storing a supply of ribbon, said ribbon supply means having an output, ribbon directing means on the movable printing carriage for directing said ribbon past the printing means, said ribbon directing means having an input on said movable printing carriage, and ribbon guiding means comprising a band having one end of which band being supported adjacent said output for receiving ribbon from said supply means and another end of which band being connected to and moved by said printing carriage for supplying the ribbon to the input of said ribbon directing means, said ribbon guiding means including means that provides a substantially constant feed length between said output of the ribbon supply means and said input of the ribbon directing means irrespective of the position of said movable printing carriage along said printing path.

32. In a printing machine of the kind having a frame, and a printing carriage movable with respect to said frame along a printing path, said printing carriage comprising printing means, the improvement comprising:

ribbon supply means carried by said frame and relatively stationary as compared to said movable printing carriage for storing a supply of ribbon, said ribbon supply means having an output, ribbon directing means on the movable printing carriage for directing said ribbon past the printing means, said ribbon directing means having an input on said movable printing carriage, and ribbon guiding means continuously flexible along substantially its entire length and which continuously extends between said output of said ribbon supply means and said input of said ribbon directing means and guides the ribbon along a path conforming to the configuration of said ribbon guiding means, having one end supported adjacent said output of said ribbon supply means for receiving ribbon from said supply means and another end connected to and moved by said printing carriage for supplying the ribbon to the input of said ribbon directing means to thereby change the configuration of said ribbon guiding means as the printing carriage moves along said printing path, said ribbon guiding means including means that provide a substantially constant feed length between said output of the ribbon supply means and said input of the ribbon directing means irrespective of the position of said movable printing carriage along said printing path.

33. In a printing machine as defined in claim 32, including means for incrementally advancing said ribbon through said ribbon guiding means as printing proceeds during the travel of said printing carriage along said printing path.

* * * * *

UNITED STATES PATENT AND TRADEMARK OFFICE

CERTIFICATE OF CORRECTION

PATENT NO. : 4,047,608

DATED : September 13, 1977

INVENTOR(S) : Frederick P. Willcox

It is certified that error appears in the above-identified patent and that said Letters Patent are hereby corrected as shown below:

Column 8, line 2, change "bond" to --band--.

Column 9, line 40, change "of" to --to--.

Signed and Sealed this

*Seventeenth* Day of *November 1981*

[SEAL]

*Attest:*

GERALD J. MOSSINGHOFF

*Attesting Officer*

*Commissioner of Patents and Trademarks*

REEXAMINATION CERTIFICATE (241st)

United States Patent [19]

Willcox

[11] B1 4,047,608

[45] Certificate Issued Sep. 4, 1984

[54] COMPLIANT RIBBON-GUIDING STRUCTURE

[76] Inventor: Frederick P. Willcox, 565 Oenoke Ridge, New Canaan, Conn. 06840

Reexamination Request:
No. 90/000,377, May 9, 1983

Reexamination Certificate for:

| | |
|---|---|
| Patent No.: | **4,047,608** |
| Issued: | **Sep. 13, 1977** |
| Appl. No.: | **672,710** |
| Filed: | **Apr. 1, 1976** |

[51] Int. Cl.[3] ..... B41J 32/00; B41J 33/24; B41J 33/06; B41J 35/04; B41L 27/18

[52] U.S. Cl. ..... 400/208; 400/228; 400/229; 400/248; 101/336

[58] Field of Search ..... 33/137, 138; 101/93.05 191/12 R; 226/195, 196; 242/76; 400/143, 194, 195, 196, 196.1, 206.4, 208, 248

[56] References Cited

U.S. PATENT DOCUMENTS

| | | | |
|---|---|---|---|
| 1,964,280 | 6/1934 | Witchger | 33/138 |
| 1,973,843 | 9/1934 | Buck | 33/137 |
| 2,074,778 | 3/1937 | Decker | 400/206.4 |
| 2,890,619 | 6/1959 | Waller | 226/196 X |
| 3,318,429 | 5/1967 | Burns et al. | 101/93.05 X |
| 3,534,847 | 10/1970 | Willcox | 400/143 |
| 3,726,381 | 4/1973 | Murphy | 400/196.1 |
| 3,941,231 | 3/1976 | Matuck et al. | 226/195 X |
| 3,977,512 | 8/1976 | Teagarden et al. | 400/82 X |

FOREIGN PATENT DOCUMENTS

| | | | |
|---|---|---|---|
| 1073054 | 1/1960 | Fed. Rep. of Germany . | |
| 1424311 | 1/1969 | Fed. Rep. of Germany . | |
| 2019648 | 11/1971 | Fed. Rep. of Germany | 400/248 |

*Primary Examiner*—Ernest T. Wright, Jr.

[57] ABSTRACT

A compliant structure formed of resilient tape of the self-straightening type is used to guide a web of thin material which is transferred between two machine elements that have relative motion to each other. The structure is applied to a ribbon supply and take-up system for typewriters and teleprinters of the type having a carriage-transported printing device. The resilient tape, with one surface being used to guide the ribbon, is connected and constrained between a frame-supported ribbon supply and take-up assembly and the printing device carriage to form a loop-like structure for guiding and generally supporting the ribbon along a path of constant length regardless of carriage position. The compliant ribbon-guiding structure is also incorporated into an easily installable ribbon carriage.

REEXAMINATION CERTIFICATE ISSUED UNDER 35 U.S.C. 307.

NO AMENDMENTS HAVE BEEN MADE TO THE PATENT.

AS A RESULT OF REEXAMINATION, IT HAS BEEN DETERMINED THAT:

The patentability of claims 1-33 is confirmed.

* * * * *